US005188688A

United States Patent [19]

Boardman et al.

[11] Patent Number: 5,188,688

[45] Date of Patent: Feb. 23, 1993

[54] METHOD OF SEALING A GELATIN CAPSULE

[75] Inventors: James R. Boardman, White Bear Lake; Ronald F. Ofstead, Maplewood, both of Minn.

[73] Assignee: Minnesota Mining and Manufacturing Company, St. Paul, Minn.

[21] Appl. No.: 556,816

[22] Filed: Jul. 20, 1990

[51] Int. Cl.[5] ..... B65B 7/00

[52] U.S. Cl. ..... 156/69; 53/471; 156/64; 156/330.9; 156/331.6; 424/454; 424/456; 524/379

[58] Field of Search ..... 156/330.9, 64, 69, 331.6; 524/379; 53/471; 424/454, 456

[56] References Cited

U.S. PATENT DOCUMENTS

| | | | |
|---|---|---|---|
| 3,071,513 | 1/1963 | De Boer et al. | 424/454 |
| 3,656,997 | 4/1972 | Cordes . | |
| 3,740,290 | 6/1973 | Kelsey et al. | 156/64 |
| 4,403,461 | 9/1983 | Goutard et al. . | |
| 4,478,658 | 10/1984 | Wittwer . | |
| 4,522,666 | 6/1985 | Wittwer . | |
| 4,534,467 | 8/1985 | Rathbun . | |
| 4,539,060 | 9/1985 | Wittwer et al. . | |
| 4,581,875 | 4/1986 | MacLaughlin et al. . | |
| 4,677,812 | 7/1987 | Tayebi . | |
| 4,756,902 | 7/1988 | Harvey et al. . | |
| 4,820,364 | 4/1989 | Graham . | |
| 4,844,906 | 7/1989 | Hermelin et al. . | |
| 4,866,906 | 9/1989 | Tayebi . | |
| 4,928,840 | 5/1990 | Barshay et al. . | |
| 4,940,499 | 7/1990 | Lebrun et al. | 156/69 |

FOREIGN PATENT DOCUMENTS

| | | | |
|---|---|---|---|
| 1198381 | 12/1985 | Canada . | |
| 0110603 | 6/1984 | European Pat. Off. . | |
| 0271292 | 6/1988 | European Pat. Off. . | |
| 1767032 | 8/1971 | Fed. Rep. of Germany . | |
| 3543956 | 6/1987 | Fed. Rep. of Germany | 424/454 |
| 40-015667 | 7/1965 | Japan . | |
| 47-050367 | 12/1972 | Japan . | |

OTHER PUBLICATIONS

Society of Manufacturing Engineers, "Proven Methods of Capsule Manufacturing Technology for the Process and Product Specialist", Article 15, Advances in Capsule Sealing Technology, 1986.

*Primary Examiner*—John J. Gallagher

*Attorney, Agent, or Firm*—Gary L. Griswold; Walter N. Kirn; John H. Hornickel

[57] ABSTRACT

A gelatin capsule sealant of a water soluble, amide-containing polymer adhesive in a volatile, essentially non-aqueous solvent is used to seal gelatin capsule sections together at less than the entire circumference of overlap between the capsule sections. The sealant may also adhere a pharmaceutical caplet within the capsule to the internal wall of the capsule. The method of applying the sealant to the capsule sections and possibly also the pharmaceutical caplet uses a drop of the sealant spread at the junction of an eccentric arcuate portion of the sections and the pharmaceutical caplet. The solvent evaporates from the sealant through the portion of the capsule section overlap not sealed. The sealant may use "generally regarded as safe" (GRAS) solvents and may also include a GRAS dye for visual indication tha that the capsule is eccentrically sealed to resist manually forced separation of the capsule sections.

20 Claims, 1 Drawing Sheet

METHOD OF SEALING A GELATIN CAPSULE

FIELD OF THE INVENTION

This invention relates to polymeric sealants for gelatin capsules and a method of using the sealant to internally and eccentrically seal vesicular gelatin sections to form a sealed gelatin capsule.

BACKGROUND OF THE INVENTION

The methods of delivery of pharmaceuticals orally in recent years has undergone significant changes. In the past, orally administered pharmaceuticals were manufactured in tablet form and more recently in a capsule form containing powders. The capsules were made generally of gelatin which generally is a water-soluble polyamide containing compound.

One of the recent changes has been an increase in the size of the tablet to be delivered orally. Another has been an interest by manufacturer, distributor, and user to assure that the vesicular sections of a gelatin capsule may not be separated to tamper with or adulterate the pharmaceutical contained in the capsule. Even more recently, to avoid issues of tampering with powders in capsules, pharmaceutical manufacturers have introduced tablets in the shape of capsules, also called caplets. These caplets may be encased in gelatin capsules, the combination sometimes called gelcaps.

Commonly, the vesicular sections of a gelatin capsule are molded to provide a force fit as one section is pressed inside the other section to form the capsule. Unfortunately, this force fit has not prevented tampering with the pharmaceutical contained in the capsule. Such malevolent tampering has caused loss of life, personal injury, withdrawal of otherwise salutary pharmaceutical products from the marketplace, and damage to the goodwill and reputation of the pharmaceutical manufacturers making and distributing otherwise salutary products.

Previous methods tried to seal gelatin capsules have been inadequate for one reason or another.

Heat has been applied to seal gelatin capsules after filling. U.S. Pat. No. 4,820,364 (Graham) discloses an "adhesion promoting fluid" such as a lower alkanol having a high dielectric constant being applied to the overlapping capsule walls and dielectric thermal energy is employed to cause local heating and sealing. In a related approach, U.S. Pat. No. 4,756,902 (Harvey et al.) discloses an alcohol/water mixture which is used as a "sealing fluid" and is applied to the overlapping section of the cap and base of the capsule. Heat may be used and a gelatin band outside the two halves of the capsule is additionally used for further sealing.

Humidity has been used as the means of bringing about capsule sealing by introducing steam briefly as the capsule is closed. See, for example, U.S. Pat. No. 4,522,666 (Wittwer). Canadian Patent No. 1,198,381, also discloses sealing by exposure to steam or hot water.

Mechanical approaches to seal capsules have been described. U.S. Pat. No. 4,534,467 (Rathbun) discloses the use of interlocking sawtooth formations on the cap interior and base exterior. U.S. Pat. No. 4,677,812 (Tayebi) and U.S. Pat. No. 4,866,906 (Tayebi) disclose the use of an indented embossed groove system to make a mechanical seal which is augmented by the use of heat to fuse the indentation. European Patent Publication No. 0 271 292 (Ansell) discloses a capsule design such that the base fits into the cap in a way that there is little or no base protruding from the cap for a tamperer to grip to open a capsule. U.S. Pat. No. 4,478,658 (Wittwer) discloses applying a frangible, edible label to cover a portion of the capsule seam on the outside of the capsule.

Sealing of gelatin capsules using various sealing materials and methods has also been described.

Sealing of the entire band or seam between the capsule halves is one approach, especially when a liquid is to be encased in the capsule.

Japanese Patent Publication No. 72050367 discloses the use of an organic solvent solution of either polyvinyl acetal diethylaminoacetate or hydroxypropylcellulose applied as a coating bandwise around the capsule using a capsule banding machine. Additives to the solvent solution to increase adhesiveness include modified cellulose materials and polyvinyl pyrrolidone.

U.S. Pat. No. 4,443,461 (Goustard et al.) discloses a mechanically elaborate capsule capping system to provide a liquid-tight seal of a hard gelatin capsule enclosing freely-flowing liquids or powders by placing a bead of viscous adhesive about the interior of the capsule cap before fitting the cap over the liquid filled base. The viscous adhesive is preferably a solution of gelatin or polyvinyl pyrrolidone in water or in a mixture of alcohol and water.

U.S. Pat. No. 4,581,875 (MacLaughlin) discloses methods of "tackifying" the overlap area of gelatin capsule base and cap by use of a thin line steam jet or impinging with atomized gelatin solution in water followed by rotating at least one half to homogenize the tackification area and fuse the halves together.

European Patent Publication No. 0 110 603 discloses the use of droplets of sealing fluid at high frequency from a jet, deposited between the overlapping regions of the cap and base for a complete seal to contain liquids and uses various means to assure that the sealing fluid (cyanoacrylate monomer, polyvinyl alcohol solution, aqueous polyvinyl pyrrolidone solution, or nitrocellulose in acetone, ethyl acetate, or methyl acetate) is distributed or deposited continuously along a seam defined by the overlapping regions.

Another chemical approach has been to modify the capsule's integrity at the point of joining the capsule sections.

Canadian Patent 1,198,381 in addition to designing capsules so that closing does not present a grippable capsule base protruding from the cap, also discloses the use of a polymer solution or emulsion containing a "softener" to seal the body to the cap. U.S. Pat. No. 4,539,060 (Wittwer) discloses the sealing of capsules by evenly distributing a sealing fluid between the overlap of the cap and body side walls of the gelatin capsule by capillary effect. The sealing fluid dissolves the amorphous part of the gelatin between the overlap.

Yet another approach has been to encase or substantially cover the filled capsule with another material. An English language abstract of German Patent No. 1767032 discloses sealing of capsules by dipping the complete capsule in a solution in an organic solvent of a natural or synthetic "binding agent", e.g., acrylic resins, polyvinyl acetates, polyvinyl pyrrolidone, cellulose acetate phthalate, cellulose ethers, alginates, etc. Japanese Patent Publication No. 65015667 discloses sealing capsules with a gel drug in the capsule base by closing with a cap which was soaked in an alcoholic solution of polyvinylpyrrolidone before closing the capsule. U.S.

Pat. No. 4,844,906 (Hermelin) discloses a capsule whose outside surface has been at least 66% covered by a tamper evident coating.

Yet another approach has been to adhesively bind each end of a caplet to the internal surfaces of the capsule with no sealing of the capsule sections at the point of overlap. U.S. Pat. No. 4,928,840 (Barshay et al.) discloses the use of an edible adhesive, including protein adhesives, a plastic adhesive, shellac or a cellulose soluble in water or an organic solvent to adhere the opposite ends of a caplet to the inside surfaces of the capsule ends. The gelatin is described as a semi-permeable membrane.

Methods employing heat, humidity or fluids which weaken the gelatin capsule are inadequate because such methods could adversely affect the integrity of the gelatin comprising the capsule or the integrity or pharmacology of the pharmaceutical inside the capsule.

Mechanical methods to attempt sealing are inadequate because such methods are complex for commercial scale manufacturing and may not thwart a tamperer who can remove the sections and restore them in the same or similar manner as those sections were originally joined.

Coating methods to encase or substantially cover the filled capsule are inadequate because of the impracticality of handling such capsules during commercial production. Coatings, many of which are water insoluble can interfere with the dissolution of the gelatin and the therapeutic release of the pharmaceutical.

Further, when a pharmaceutical caplet is encased in a gelatin capsule, to form a gelcap, the caplet dimensions are smaller than the capsule, permitting the caplet to move about within the capsule. Because the caplet density is invariably higher than the capsule density, the mobility of the caplet within the capsule can damage the capsule or otherwise provide an unsettling sound and feeling as the user takes the gelcap orally.

What is needed for the art of gelatin capsule assembly is a sealant and a method for sealing capsules which will effectively seal the two sections of the gelatin capsule together with minimal processing changes to conventional gelatin capsule assembly but without altering the appearance or performance of the gelatin capsule or the pharmacology of the pharmaceutical, in order to minimize tampering, and desirably also to immobilize a caplet within a capsule.

SUMMARY OF THE INVENTION

The present invention solves the problems encountered in the art of gelatin capsule assembly and usage, by providing a water soluble, amide-containing polymer which will eccentrically seal a portion of the internal junction between first and second vesicular capsule sections to form an eccentrically sealed gelatin capsule. An "eccentric seal" for purposes of this invention means that only an arc (<360°) of the circumference of the junction between the first and second vesicular sections of the capsule is sealed.

The gelatin capsule sealant is a water soluble, amide-containing polymer adhesive in a volatile, essentially non-aqueous solvent, "generally regarded as safe" (GRAS) by the United States Food and Drug Administration for human ingestion. An "essentially" non-aqueous solvent for purposes of this invention is a solvent which has no water or such small amount of water that the solvent will not dissolve or otherwise affect the integrity of the water-soluble gelatin capsule walls or the pharmaceutical in the capsule.

The method of sealing the gelatin capsule at the time of assembly includes placing some sealant at or near the apex of the caplet residing in a capsule section, placing the second capsule section over the perimeter of the first capsule section and into an overlapping relationship with the first capsule section, thereby smearing the sealant between the two capsule sections from near the apex of the caplet at least to the point of overlap, and evaporating the solvent from the sealant to eccentrically and internally seal the first and second capsule sections together to form a gelatin capsule.

Once assembled, the sealed gelatin capsule has the first and second vesicular mating capsule sections sealed by the amide-containing polymer adhesive at less than 360° of the mating surfaces of the first and second vesicular capsule sections.

A feature of the invention is the sealing of the gelatin capsule in a manner which avoids any twisting or rotating of one capsule section relative to another.

Another feature of the invention is providing a minimal amount of sealant between the two capsule sections but a sufficient amount to prevent opening or separating of the capsule sections without visible damage to the capsule.

Another feature of the invention is the delivery of sealant to a capsule section containing a pharmaceutical caplet, before mating with the other capsule section, whereby the sealant not only internally seals the two capsule sections together but also seals the caplet to the gelatin capsule.

Another feature of the invention is that the sealant does not affect the structural integrity of the gelatin capsule sections during or after assembly, adversely affect the pharmacology of the pharmaceutical, or prevent the dissolution of the gelatin capsule upon ingestion.

An advantage of the method of the invention is that the eccentric application of the sealant to an arcuate portion of the capsule sections allows facile removal of the volatile organic solvent used to apply the sealant, thereby avoiding the presence of undesirable solvent residues in the capsule and near the pharmaceutical.

Another advantage of the invention is that the sealant may provide a visible indication of a sealed capsule.

A more detailed understanding of the scope of the present invention, and its embodiments follows.

EMBODIMENTS OF THE INVENTION

Gelatin Capsule Sections

Figure 1:
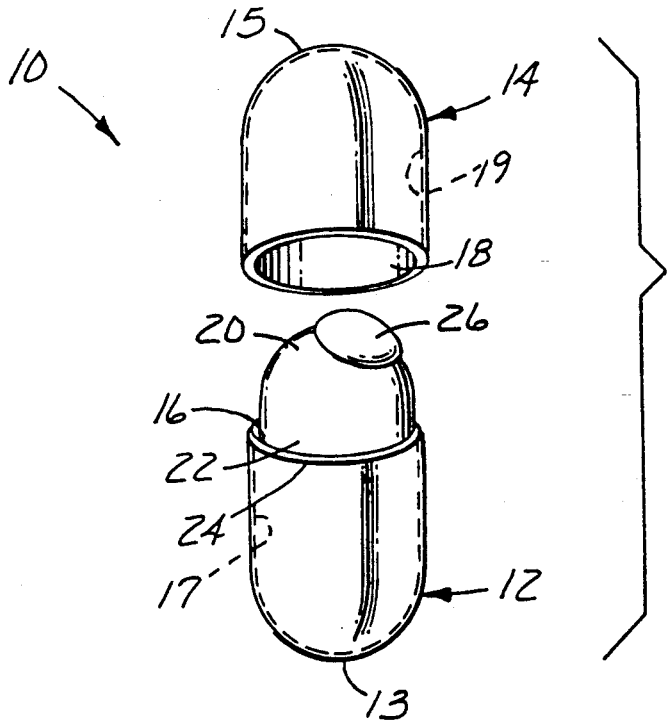
FIG. 1 is a side view of the gelatin capsule sections prior to assembly, wherein the first section contains a caplet and some sealant in a location at or near the geometric vertical axis of the capsule section and the caplet.

As seen in FIG. 1, both sections of the gelatin capsule are vesicular and generally may be cylindrical in shape. Other vesicular shapes may be used with the capsule sealant of the present invention.

Gelatin capsule 10 is composed of a first vesicular section 12 and a second vesicular section 14. For purposes of describing this invention, the first section 12 is the base section which receives the pharmaceutical during capsule assembly. The second section 14 is the cap section which covers the pharmaceutical and the first section in an overlapping fashion.

Each vesicular section 12 and 14 has a closed end, 13 and 15 respectively, and an opposing opening perimeter, 16 and 18 respectively. The overlapping of the sections 12 and 14 is accomplished by sliding the second section 14 over the first section 12 such that the outer side wall 17 of the lower section 12 is overlapped by the inner side wall 19 of upper section 14.

The cavity of the gelatin capsule 10 is formed by the vesicular cavities of sections 12 and 14 after they have been joined. The cavity is of such size as to permit a suitable dosage of pharmaceutical in the form of tablet, caplet, or other solid pharmaceutical preparation to reside between sections 12 and 14 upon assembly of capsule 10.

In FIG. 1, the gelatin capsule 10 contains a pharmaceutical caplet 20. The pharmaceutical caplet 20 has an outer surface 22, a portion of which may protrude from the opening perimeter 16 of first vesicular section 12. Around the caplet outer surface 22 at the opening perimeter 16 is a caplet perimeter internal annular junction 24. The capsule sections 12 and 14 may be sealed using sealant of the present invention placed in the form of a drop 26 near the apex of the caplet 20 extending from capsule 10. The sealant should not be applied about the entire annular junction 24 or in a manner which permits the sealant to flow bandwise about the annular junction 24. Indeed, it is preferred that the sealant drop 26 be applied eccentrically to the vertical axis of capsule 10, in order to permit evaporative venting of solvent used with the sealant drop 26 from inside capsule sections 12 and 14. If the sealant drop 26 is placed at the apex of caplet 20, care must be taken to apply sealant of such viscosity which will prevent the sealant from spreading annularly down caplet surface 22 to junction 24.

Alternatively, if sealant drop 26 is of sufficient viscosity, it may be placed at junction 24 and remain essentially in place until section 14 is mated with section 12.

Figure 2:
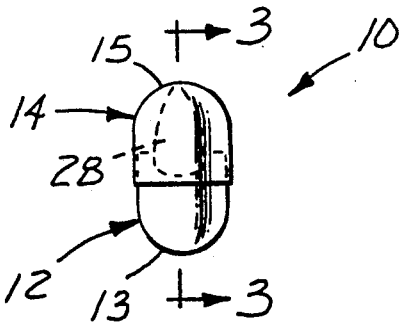
FIG. 2 is a side view, rotated along the geometric vertical axis 90° from the side view of FIG. 1, of the assembled gelatin capsule showing the eccentric sealing of the capsule sections.

Referring to FIG. 2, the assembled gelatin capsule 10 is shown. FIG. 2 demonstrates there is an overlap between the inner side wall 19 of second vesicular section 14 and the outer side wall 17 of first vesicular section 12. The amount of overlap may be determined by those skilled in the art of manufacture and assembly of gelatin capsule pharmaceutical products. For purposes of this invention, any amount of overlap sufficient to provide an area in which the sealant drop 26 of FIG. 1 may contact both walls 17 and 19 is acceptable. Within capsule 10 is pharmaceutical caplet 20. A caplet 20 is usually smaller than the cavity of capsule 10 and has some mobility within capsule 10.

As the second vesicular section 14 is placed over the opening perimeter 16 of first vesicular section 12, the sealant drop 26 is spread along the outer surface 22 of caplet 20 and along the inner side wall 19 of second vesicular section 14. The sealant spread 28 is seen in FIG. 2 in dotted lines and also in FIG. 3 cross-sectionally as contacting both the inner side wall 19 of second vesicular section 14 and outer side wall 17 of first vesicular section 12 to an arcuate portion of internal junction 24. Further, the sealant spread 28 provides securement of the caplet 20 at its outer surface 22 to either the inner side wall 30 of first vesicular section 12, the inner side wall 19 of second vesicular section 14, or both.

Sealant spread 28 forms an adhesive film among first and second sections 12 and 14 and caplet 20 after evaporation of solvent from the sealant spread 28. Venting of the solvent from inside the capsule occurs through the remainder of the annular junction 24 not eccentrically sealed.

Capsule Sealant

Polymer Adhesive

The capsule sealant comprises a polymer adhesive in a essentially non-aqueous solvent. The polymer adhesive must be capable of adhering to the composition of the gelatin capsule sections 12 and 14 and desirably capable of adhering to the outer surface 22 of caplet 20. The polymer adhesive should be water soluble to minimize interference of the dissolution of the gelatin capsule sections 12 and 14 upon ingestion. Thus, the gelatin capsule sealant eccentrically seals the gelatin capsule sections 12 and 14 in a manner which minimizes separation without visible damage to the gelatin capsule 10 yet preserves the appearance and performance characteristics of the capsule 10.

The water soluble polymer adhesive is comprised of polymeric repeating units having an amide moiety contained therein. The amide moiety may be within the polymeric repeating unit or appended to the polymeric repeating unit. The amide moiety may be primary, secondary, or tertiary in nature.

The molar ratio of the amide moiety to the number of carbon atoms in the polymeric repeating unit backbone and any pendant groups to the backbone is from about 1:2 to about 1:6. Desirably, the molar ratio of the amide moiety to the carbon atoms in the polymeric repeating unit is from about 1:3 to about 1:5. Preferably, the molar ratio of the amide moiety to the carbon atoms in the polymeric repeating unit is from about 1:4 to about 1:5.

Non-limiting examples of polymers having an amide moiety pending from the polymeric repeating unit (with molar ratio of amide moiety to carbon atoms in the polymeric repeating unit shown) include poly-N-vinylpyrrolidone (1:5), poly-N-vinyl-N-methylacetamide (1:4), polyacrylamide (1:2), polymethacrylamide (1:3), poly-N,N-dimethylacrylamide (1:4), poly-N,N-dimethylmethacrylamide (1:4), or poly-N-vinylpiperidone (1:6).

A non-limiting example of a polymer having the amide moiety within the polymeric repeating unit is polyethyloxazoline having a molar ratio of 1:3.

The water solubility of the polymer adhesive should be greater than about 10 grams/liter and desirably greater than about 100 grams/liter of water.

Of the possible polymers useful as the polymer adhesive in the present invention, poly N-vinyl lactams are desirable. Of these poly N-vinyl lactams, poly N-vinylpyrrolidone is preferred. The poly N-vinylpyrrolidone should be linear and uncrosslinked to maintain water solubility in an amount desired above.

Non-Aqueous Solvent

The sealant of the present invention comprises a water soluble amide-containing polymer adhesive in a essentially non-aqueous solvent. The polymer adhesive may be dissolved in, dispersed in, or swollen in the essentially non-aqueous solvent. The solvent must be essentially non-aqueous to minimize interaction with the composition of the gelatin capsule sections and must not otherwise affect the composition of the pharmaceutical to be contained in the gelatin capsule.

The essentially non-aqueous solvent should also be volatile to evaporate under ambient conditions or slightly elevated temperatures, e.g., to about 50° C., to convert sealant spread 28 into an adhesive film of the amide-containing polymer adhesive, adhering to both capsule sections 12 and 14 and desirably to the caplet 20 at the caplet perimeter annular junction 24.

Non-limiting examples of acceptable solvents are those which are "generally regarded as safe" (GRAS) by the United States Food and Drug Administration for human ingestion, provided such GRAS solvents also are sufficiently volatile and essentially non-aqueous. Among those GRAS listed solvents are included alkyl alcohols having between 1 and 4 carbon atoms and ketones such as acetone. GRAS solvents are listed among other places in 21 C.F.R. Part 170 et seq., incorporated by reference, and particularly in Part 173 Subpart C and Part 184.1293 thereof.

Of these GRAS listed solvents, anhydrous ethanol is preferred.

The amount of polymer adhesive in the volatile, essentially non-aqueous solvent may be determined according to the viscosity of the sealant desired, taking into account a balance of factors necessary for processing of the assembly of the gelatin capsule.

One factor is that the sealant drop 26 should remain in position at the dispensed location at or near the apex of the caplet 20 until such time as the second vesicular section 14 is mated with the first vesicular section 12 during assembly of the capsule 10. In other words, the sealant drop should be sufficiently viscous to minimize seepage of the sealant drop 26 annularly about capsule surface 22 before the second section 14 is placed in overlapping fashion over first section 12.

Another factor important to the amount of polymer adhesive in the essentially non-aqueous solvent is the amount of solvent which must evaporate in an acceptable processing time in order to permit the polymer adhesive to form a film adhesive seal at junction 24.

Yet another factor in determining the amount of polymer adhesive to be in the essentially non-aqueous solvent is the strength of the resulting internal eccentric seal formed at junction 24.

Viscosity of the sealant may be controlled by selecting the appropriate molecular weight of the polymer adhesive and the appropriate percent solids of the adhesive in the essentially non-aqueous solvent. Generally, the molecular weight of the polymer adhesive may range from about 10,000 to about 500,000 and desirably from about 40,000 to about 360,000 when the polymer adhesive comprises from about 40 to about 20 weight percent solids in the volatile, essentially non-aqueous solvent.

Acceptable viscosities of sealant range from about 10 cps. to about 5000 cps at ambient temperatures and pressures. Desirably, the viscosity of sealant ranges from about 20 cps. to about 500 cps., and preferably from about 200 cps. to about 400 cps. At this preferred range, a metered sealant drop 26 may be placed at or near the apex of the caplet 20 and remain essentially in that place until second vesicular section 14 is placed over the first section 12 to convert sealant drop 26 into sealant spread 28.

Other non-toxic materials nonreactive to the pharmaceutical, the gelatin capsule sections, and the polymer adhesive may be added to the capsule sealant for various purposes. A non-limiting example is the addition of an ingestable dye or food coloring which may used to visually indicate the presence of an eccentrically sealed capsule. The capsule sections 12 and 14 may be the same or different colors, although generally also translucent due to their wall thicknesses. The use of a dye or other direct or indirect food additive generally regarded as safe (c.f. 21 C.F.R. Part 170 et seq.) is acceptable.

Method of Sealed Capsule Assembly

As described previously, a sealant drop 26 deposited at or near the apex of the caplet 20 or alternatively at an arcuate portion of perimeter 16 provides the necessary sealing of the mateable first and second vesicular capsule sections 12 and 14. The location of the sealant spreading contacts annular junction 24 in an arc of less than 360°, e.g., an arc of less than about 300°, and desirably less than about 270°, and preferably less than an arc of about 200°. Providing adhesive drops which flow to rest about the entire annulus of the junction 24 creates a physical barrier to solvent evaporation and a partial pressure of solvent within the enclosed gelatin capsule 10 which inhibits the evaporation of the solvent from the sealant. Therefore, an application of the solvent drop 26 at or near the apex of the caplet 20 which spreads eccentrically between caplet surface 22 and capsule surface 19 minimizes the material used to seal the gelatin capsule sections 12 and 14 and facilitates the processes of evaporation and adhesive film formation at that portion of junction 24.

The adhesive drop may be administered by a pressurized metered dropper such as a commercially available mix syringe.

The second vesicular section 14 is placed directly over the perimeter 16 of the first section 12 according to conventional capsule assembly techniques known in the art. Because of the desire to avoid applying sealant about the entire circumference of the annular junction 24, there is no need to rotate or otherwise twist one section of the capsule 10 relative to another section of the capsule. Indeed, to facilitate minimal alterations to capsule assembly techniques currently employed, it is preferred that the sealant drop 26 be converted to sealant spread 28 in a longitudinal direction from at or near the apex of the capsule 20 to an arcuate portion of junction 24 as second section 14 is mated with first section 12.

Any volatile, essentially non-aqueous solvent remaining in the sealant spread 28 may be removed through the natural process of evaporation of the volatile liquid or acceleration of that evaporation process by the application of heat to a temperature not exceeding about 80° C. and preferably not exceeding a temperature of about 50° C. The application of heat to the extremities of the gelatin capsule should be controlled to facilitate evaporation without deleteriously affecting the gelatin capsule 10, the pharmaceutical 20, or the sealant spread 28 forming into the adhesive film.

Formulation of the Sealant

The water soluble, amide-containing polymer adhesive may be mixed into the volatile, essentially non-aqueous solvent according to techniques common to those skilled in the art. For example, the polymer solid may be added to the solvent in a vessel equipped with mechanical agitation sufficient to prevent agglomeration of the polymer into difficult-to-dissolve agglomerates. When polymer dissolution is complete, the solution may be filtered by known methods to remove any insoluble matter, dust, lint, etc. Preferably, poly-N-vinylpyrrolidone may be mixed into ethanol at ambient pressures and temperatures using agitation of about 100–1000 rpm.

USEFULNESS OF THE INVENTION

Notwithstanding dye coloration of capsule sections 12 and 14, (sometimes using different colorations as between sections 12 and 14), it is possible to determine the extent of overlap between sections 12 and 14 by careful examination of the capsule 10. The capsule eccentric seal is both visibly noticeable at an arcuate portion of the annulus of overlap through the capsule walls and tactily noticeable due to the inability to readily separate capsule sections 12 and 14 from each other after sealant spread 28 forms the adhesive bond between sections 12 and 14.

Optionally, and in consideration of the various dye colorations chosen for capsule sections 12 and 14, the sealant may also comprise a dye which is the same as, different from, or chromatically compatible with, one or both colors of dye sections 12 and 14. The presence of dye in the sealant may be used by the manufacturer of capsule 10 to positively visually indicate the eccentric seal.

Figure 3:
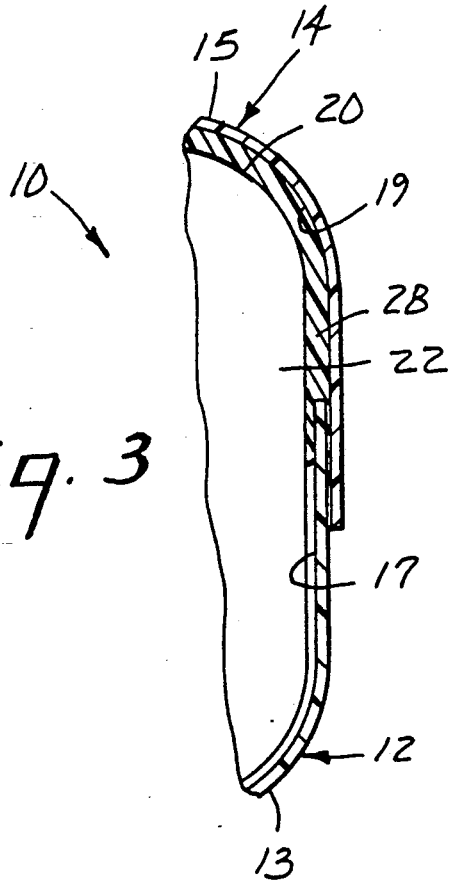
FIG. 3 is an exploded view of the cross-section taken along lines 3—3 of FIG. 2, showing the sealant spread between the first and second gelatin capsule sections and also securing the caplet to the gelatin capsule so formed.

As seen in FIG. 3, the sealant spread 28 may extend between the outer surface 22 of the caplet 20 and both the inner side wall 19 of second section 14 and the inner side wall 17 of first section 12. Adhesive in this location minimizes the mobility of the caplet 20 within the eccentrically sealed gelatin capsule 10. Thus, the caplet does not rattle inside the gelatin capsule during storage, handling, or ingestion.

The sealant spread 28 in gelatin capsule 10 provides a sealing strength which may be measured by attempting to separate the capsule sections manually. Desirably, the capsule may not be separated without altering the physical appearance of the capsule sections or the eccentric seal. Preferably, the capsule may not be separated without cracking, tearing, crushing, or otherwise damaging the capsule sections.

Details of the embodiments of the invention continue in the following examples.

EXAMPLE 1

A variety of polymer adhesives having various molecular weights were dissolved in various essentially non-aqueous solvents at room temperatures and pressures with minimal agitation to obtain solutions of various viscosities described in Table I below. After filtering any solids from the solutions, each of the solutions were placed in syringes fitted with a 16 g. needle. For each of the variety of solutions, a capsule was prepared.

Into one section of a gelatin capsule (approximately 0.7 cm in diameter, 1.9 cm in interior depth, and 2.1 cm in outside length available from Capsugel, Inc. of Greenwood, S.C.) was placed a pharmaceutical caplet (approximately 0.6 cm in diameter and 2.0 cm in length) with the caplet protruding approximately 0.1 cm from the 1.9 cm interior depth of capsule section.

Each capsule section was oriented in a vertical line and one drop of the various solutions was applied to at or near the top of each caplet. The viscous drop began to slowly flow down the surface of each caplet adjacent to less than one quarter of the circumference of each capsule perimeter, and a capsule cap was firmly placed over each capsule section housing a caplet. Each closed capsule was allowed to dry overnight under normal room temperatures, humidities, and pressures. Each closed capsule was tested for sealing effectiveness by attempting to manually separate the capsule sections by applying a thumb and forefinger grip with each hand to opposing capsule sections and attempting to pull the capsule apart. None of the closed capsules could be opened manually. Further, each of the caplets in the closed capsules was adhered to the capsule and did not rattle upon movement of the capsule.

Table I shows the various combinations of polymer adhesives, essentially non-aqueous solvents, and viscosities of the solutions used to eccentrically and internally seal each of the capsules described above.

TABLE I

| Polymer Adhesive | Molecular Weight | Non-Aqueous Solvent | Weight % Adhesive | Viscosity (5) (cps.) |
|---|---|---|---|---|
| PNVP (1) | 40,000 | Ethanol | 30 | 20 |
| PNVP | 40,000 | Ethanol | 40 | 295 |
| PNVP | 360,000 | Ethanol | 20 | 4100 |
| PEOX (2) | — | Ethanol | 42 | — |
| DMA (3) | — | Ethanol | 25 | — |
| MVA (4) | — | Ethanol | 40 | — |

(1) PNVP is poly-N-vinylpyrrolidone commercially available from Aldrich Chemical Co., Milwaukee, Wisconsin (2) PEOX is polyethyloxazoline commercially available from Dow Chemical Co., Midland, Michigan (3) DMA is poly(N,N-dimethylacrylamide), prepared by thermally-induced free radical polymerization of N,N-dimethylacrylamide monomer in ethyl acetate solvent at 80° C. using azo-bis-isobutyronitrile as initiator. Polymeric product was isolated by pouring the reaction mixture into diethyl ether to precipitate the product, which was then isolated by filtration and drying. The test solution in ethanol was prepared by agitation of one part polymer in three parts ethanol until solution was complete. The solution was filtered in order to remove traces of lint.

(4) MVA is poly(N-methyl-N-vinylacetamide), prepared by thermally-induced free radical polymerization of N-methyl-N-vinylacetamide monomer in ethyl acetate solvent at 80° C. using azo-bis-isobutyronitrile as initiator. Polymeric product was isolated by pouring the reaction mixture into diethyl ether to precipitate the product, which was then isolated by filtration and drying. The tset solution in ethanol was prepared by agitation of one part of polymer with 1.5 parts ethanol until solution was complete. The solution was filtered in order to remove traces of lint.

(5) Viscosities were measured on a Brookfield Model LVT viscosimeter, using the procedures specified by the manufacturer in the instrument operation manual.

EXAMPLE 2

PNVP polymers in three different molecular weights (10,000; 40,000; and 360,000) were dissolved into ethanol in three different weight percents (60%, 40%, and 20%, respectively). The three solutions were used in the method according to Example 1 to eccentrically and internally seal caplet-containing gelatin capsules. All three solutions provided some success in sealing the capsules against manual separation. The 10,000/60% solution was a successful eccentric seal avoiding manual capsule separation in 4 of 10 instances, while the 40,000/40% and 360,000/20% solutions provided a successful eccentric seal avoiding manual capsule separation in 9 of 10 instances.

EXAMPLE 3

To determine the effects of moisture on the capsule sealant composition and method of eccentric sealing, the method of preparing the capsule sealant composition was carefully controlled. PNVP (M.W. 40,000) was thoroughly dried in an oven at 110° C. for 18 hours minutes and blended with a quantity of anhydrous ethanol from a freshly opened bottle to make a 40 weight percent solution of "dry" capsule sealant composition. A second amount of PNVP was exposed to 50% Relative Humidity conditions at constant temperature of 22° C. until moisture equilibration and then blended with a previously opened and humidity equilibrated bottle of ethanol to make a 40 weight percent solution of "humid" capsule sealant composition. Capsules were eccentrically sealed according to the procedures of Example 1 with the "dry" solution and the "humid" solution. The "dry" solution was a successful eccentric seal avoiding manual capsule separation in 9 of 10 instances, while the "humid" solution provided a successful eccentric seal avoiding manual capsule separation in 5 of 10 instances. The presence of moisture in capsule sealant composition renders the strength of the eccentric seal more marginal; the presence of water in the solvent would make the eccentric seal even more marginal.

EXAMPLE 4

To determine the amount of capsule sealant composition to be applied to the capsule and caplet to create an effective eccentric seal, the method of applying samples of a 40,000 M.W. PNVP 40 weight percent ethanol solution was varied from the procedure described in Example 1. Syringes having needle orifice sizes of 18, 16, 14, and 13 gauge were found to deliver droplets of 0.01095, 0.01315, 0.015173, and 0.016948 grams of capsule sealant solution, respectively. While the 13 and 14 gauge needle orifice sizes delivered larger masses of capsule sealant solution, the percent success rate to resist manually forced capsule separation was about 50%. By comparison, the smaller 16 and 18 gauge needle orifice sizes delivered smaller masses of solution but provided a 90 percent success rate against manually forced capsule separation. Larger masses of solution also delivered larger masses of solvent to evaporate from the sealant spread.

EXAMPLE 5

Three samples of 40,000 M.W. PNVP were prepared in solutions of ethanol, methanol, and acetone to produce 40 weight percent capsule sealant solutions. Each of the solutions were used to eccentrically seal capsules according to the procedure described in Example 1. Examination of the capsules eccentrically sealed with the methanol-based solution showed less rapid evaporation of methanol from the capsule. Examination of the capsules eccentricially sealed with acetone-based solution showed very rapid evaporation of acetone. As found with respect to Examples 1–4, examination of the capsules eccentrically sealed with ethanol-based solution showed moderate evaporation of ethanol and the formation of an eccentric seal which had a 90% success rate against manually forced capsule separation.

EXAMPLE 6

A small amount of "reactive red dye" commercially available from Sigma Chemical Co. of St. Louis, Mo. was added to 40,000 M.W. PNVP 40 weight percent ethanol capsule sealant solution prepared according to Example 1. The red dyed capsule sealant solution was used to seal capsules according to the procedure described in Example 1. The relatively translucent walls of the capsule sections showed the amount of overlap and the extent to which the red dyed eccentric seal formed at the overlap. The extent of overlap eccentrically sealed was an arcuate portion of about 180° of the circumference of the overlap. The eccentric seal had a 90% success rate against manually forced capsule separation.

By comparison, the red dyed capsule sealant solution was used to annularly seal capsules by applying the sealant drop in the same manner as described in Example 1, followed by rotating the capsule cap and base sections relative to each other until it was seen that the red dyed sealant spread was distributed about the entire circumference of the overlap. By comparison to the eccentrically sealed capsules, the annularly sealed capsules were extremely slow to dry, leaving solvent and undried capsule sealant inside the capsule after several days of drying. This inadequate drying of the annular seal provided at best a weakly sealed or unsealed capsule having no measurable success rate against manually forced capsule separation. Every capsule could still be reopened easily. The sealant spread had not dried in any of the capsules.

EXAMPLE 7

Fifty capsules were eccentrically sealed according to the procedure described in Example 1 with a 40,000 M.W. PNVP 40 weight percent ethanol solution prepared according to Example 1. The fifty capsules were placed inside a 120 ml glass bottle clamped horizontally to a flat bed Eberbach laboratory shaker, otherwise used to agitate chemical mixtures. The agitation was designed to simulate extensive vibration and impact forces that might be encountered by the capsules during manufacture and shipment. The shaker agitated the capsules in the glass bottle for a continuous 48 hours. The fifty capsules were removed and found to have a 100% success rate against manually forced capsule separation. The eccentric seal of the fifty capsules was strong and not brittle or easily damaged by considerable impact.

Without being limited to the foregoing, the present invention is hereby claimed.

What is claimed is:

1. A method for sealing mateable first and second vesicular capsule sections to form an eccentrically and internally sealed gelatin capsule, comprising:

(a) placing sealant, comprising a water-soluble, amide-containing polymer adhesive in a volatile, essentially non-aqueous solvent, on less than 360° of a perimeter of the first capsule section, said perimeter defining an opening;

(b) placing the second capsule section over said perimeter of said first capsule section and into an overlapping relationship with said first capsule section thereby spreading said sealant at the overlap;

(c) evaporating the solvent from said sealant to eccentrically and internally seal the first and second capsule sections in the form of a gelatin capsule.

2. The method according to claim 1, wherein said sealant is of such viscosity as to minimize movement of said sealant between said placing step (a) and said placing step (b).

3. The method according to claim 1, wherein said amide-containing polymer adhesive is comprised of polymeric repeating units having carbon atoms and an amide moiety in a molar ratio of from about 1:2 to about 1:6 amide moiety to carbon atoms.

4. The method according to claim 3, wherein said amide moiety in said polymeric repeating unit is primary or tertiary.

5. The method according to claim 3, wherein said polymer adhesive comprises poly-N-vinylpyrrolidone, poly-N-vinyl-N-methylacetamide, polyacrylamide, polymethacrylamide, poly-N,N-dimethylacrylamide, poly-N,N-dimethylmethacrylamide, poly-N-vinylpiperidone, polyethyloxazoline, or combinations thereof.

6. The method according to claim 3, wherein said polymer adhesive comprises poly-N-vinylpyrrolidone.

7. The method according to claim 1, wherein said solvent comprises an alkyl alcohol having from 1 to 4 carbon atoms.

8. The method according to claim 7, wherein said solvent comprises ethanol.

9. The method according to claim 8, wherein said polymer adhesive comprises poly-N-vinylpyrrolidone.

10. The method according to claim 1, wherein said sealant further comprises an additive generally regarded as safe for human ingestion.

11. The method according to claim 10, wherein said additive is a dye.

12. The method according to claim 1, wherein said placing step (a) further comprises placing a pharmaceutical caplet in the first capsule section and placing said sealant on a surface of said pharmaceutical caplet such that said sealant will contact less than 360° of said perimeter when said capsule sections are mated; and wherein said placing step (b) further results in spreading said sealant on said pharmaceutical caplet surface adjacent at least one of the capsule sections, and wherein said evaporating step (c) further results in eccentrically and internally sealing said pharmaceutical caplet to at least one of the capsule sections.

13. A method for eccentrically and internally sealing a pharmaceutical caplet in mateable first and second vesicular gelatin capsule sections, comprising:

(a) placing the pharmaceutical caplet in the first capsule section;

(b) placing sealant, comprising a water-soluble, amide-containing polymer adhesive in a volatile, essentially non-aqueous solvent, on a surface of the caplet such that the sealant will contact less than 360° of a perimeter of the first capsule section when said capsule sections are mated;

(c) placing the second capsule section over the perimeter of said first capsule section and into an overlapping relationship with the first capsule section such that the sealant contacts the second capsule section;

(d) evaporating the solvent from the sealant to eccentrically and internally seal the caplet in the first and second capsule sections.

14. The method according to claim 13, wherein the amide-containing polymer adhesive is comprised of polymeric repeating units having carbon atoms and an amide moiety in a molar ratio of from about 1:2 to about 1:6 amide moiety to carbon atoms.

15. The method according to claim 14, wherein the polymer adhesive comprises poly-N-vinylpyrrolidone, poly-N-vinyl-N-methylacetamide, polyacrylamide, polymethacrylamide, poly-N,N-dimethylacrylamide, poly-N,N-dimethylmethacrylamide, poly-N-vinylpiperidone, polyethyloxazoline, or combinations thereof.

16. The method according to claim 14, wherein the polymer adhesive comprises poly-N-vinylpyrrolidone.

17. The method according to claim 13, wherein the solvent comprises an alkyl alcohol having from 1 to 4 carbon atoms.

18. The method according to claim 17, wherein the solvent comprises ethanol.

19. The method according to claim 18, wherein the polymer adhesive comprises poly-N-vinylpyrrolidone.

20. The method according to claim 13, wherein the sealant further comprises a dye generally regarded as safe for human ingestion.

* * * * *